United States Patent [19]

Wissmann et al.

[11] Patent Number: 4,597,371

[45] Date of Patent: Jul. 1, 1986

[54] FUEL INJECTION APPARATUS FOR TWO-STROKE ENGINES

[75] Inventors: Michael Wissmann, Markgröningen; Hans Nickel, Cottenweiler, both of Fed. Rep. of Germany

[73] Assignee: Andreas Stihl, Waiblingen, Fed. Rep. of Germany

[21] Appl. No.: 704,082

[22] Filed: Feb. 21, 1985

[30] Foreign Application Priority Data

Feb. 21, 1984 [DE] Fed. Rep. of Germany ..... 3406120

[51] Int. Cl.[4] ..... F02M 39/00

[52] U.S. Cl. ..... 123/495; 123/447; 417/289

[58] Field of Search ..... 123/495, 446, 514, 447; 417/289, 309

[56] References Cited

U.S. PATENT DOCUMENTS

| | | | |
|---|---|---|---|
| 2,010,165 | 8/1935 | Tear | 417/289 |
| 3,117,524 | 1/1964 | Budzich | 417/289 |
| 3,357,363 | 12/1967 | Raymond | 417/289 |
| 4,082,072 | 4/1978 | Johnson | 123/495 |

*Primary Examiner*—Carl Stuart Miller

*Attorney, Agent, or Firm*—Walter Ottesen

[57] ABSTRACT

The invention is directed to a fuel injection apparatus for two-stroke engines and is especially for small engines of high-speed tools such as motor-driven chain saws, for example. It provides for the valve-controlled input of fuel into a pressure chamber of a housing and includes a spring-loaded pump piston journalled for reciprocatory movement in a bore to supply the fuel. The pump piston is sealed by an annular seal. For fuel induction, the pump piston has a passageway opening into the pressure chamber and a valve seat. The valve seat of the pump piston cooperates with a substantially free-flying sealing body for opening and closing the valve.

22 Claims, 2 Drawing Figures

FUEL INJECTION APPARATUS FOR TWO-STROKE ENGINES

FIELD OF THE INVENTION

The invention relates to a fuel injection apparatus for two-stroke engines. The fuel injection apparatus of the invention is especially suited for small engines of fast running working tools such as chain saws for example.

BACKGROUND OF THE INVENTION

In a fuel injection apparatus of the type disclosed in the publication "Motorrad" 32/1956, page 1038, a suction valve is arranged on the side of the pressure chamber opposite the pump piston to introduce fuel into the pressure chamber during the return stroke of the pump piston. It is a disadvantage of this arrangement that the control of the fuel introduced into the pressure chamber is not reliable, particularly in a small high-speed engine where only a very low pressure chamber volume of about 1 to 2 $mm^3$ per piston stroke is provided for metering a minimum possible amount of fuel. It is also known from Bosch publication VDT-UPB 001/10 5.53 to lap the pump piston for fuel injection. Such lapping requires a very high finishing accuracy involving a highly complex procedure particularly with small piston diameters. In addition, with the diameters becoming progressively smaller, leakage losses increase disproportionately when referred to the volume of the pressure chamber. As a result, apart from being complicated and expensive to manufacture, these apparatus do not provide sufficiently accurate control possibilities in small high-speed engines.

SUMMARY OF THE INVENTION

It is an object of the invention to provide an improved injection apparatus wherein an accurately controllable amount of fuel is admitted into the pressure chamber by the piston with simple means.

The fuel injection apparatus of the invention is for a two-stroke engine such as small engines for fast running work tools. One example of such a work tool is a chain saw.

The fuel injection apparatus of the invention includes: a housing; pressure chamber means formed in the housing for receiving fuel to be injected into the engine; valve means for controlling the admission of fuel into the chamber; a pump piston mounted in the housing for reciprocatory movement therein along a predetermined axis; channel means formed in the pump piston for conducting fuel into the pressure chamber means; fuel supply means for supplying fuel to the channel means; valve means for opening and closing the channel means in dependency upon the movement of the pump piston; and, actuating means for imparting the reciprocatory movement to the pump piston.

Preferred embodiments and improvements as well as further advantages and essential details of the invention will become apparent from the drawing, the description, and the claims.

BRIEF DESCRIPTION OF THE DRAWING

The invention will now be described with reference to the drawing wherein.

DESCRIPTION OF THE PREFERRED EMBODIMENTS OF THE INVENTION

Figure 1:
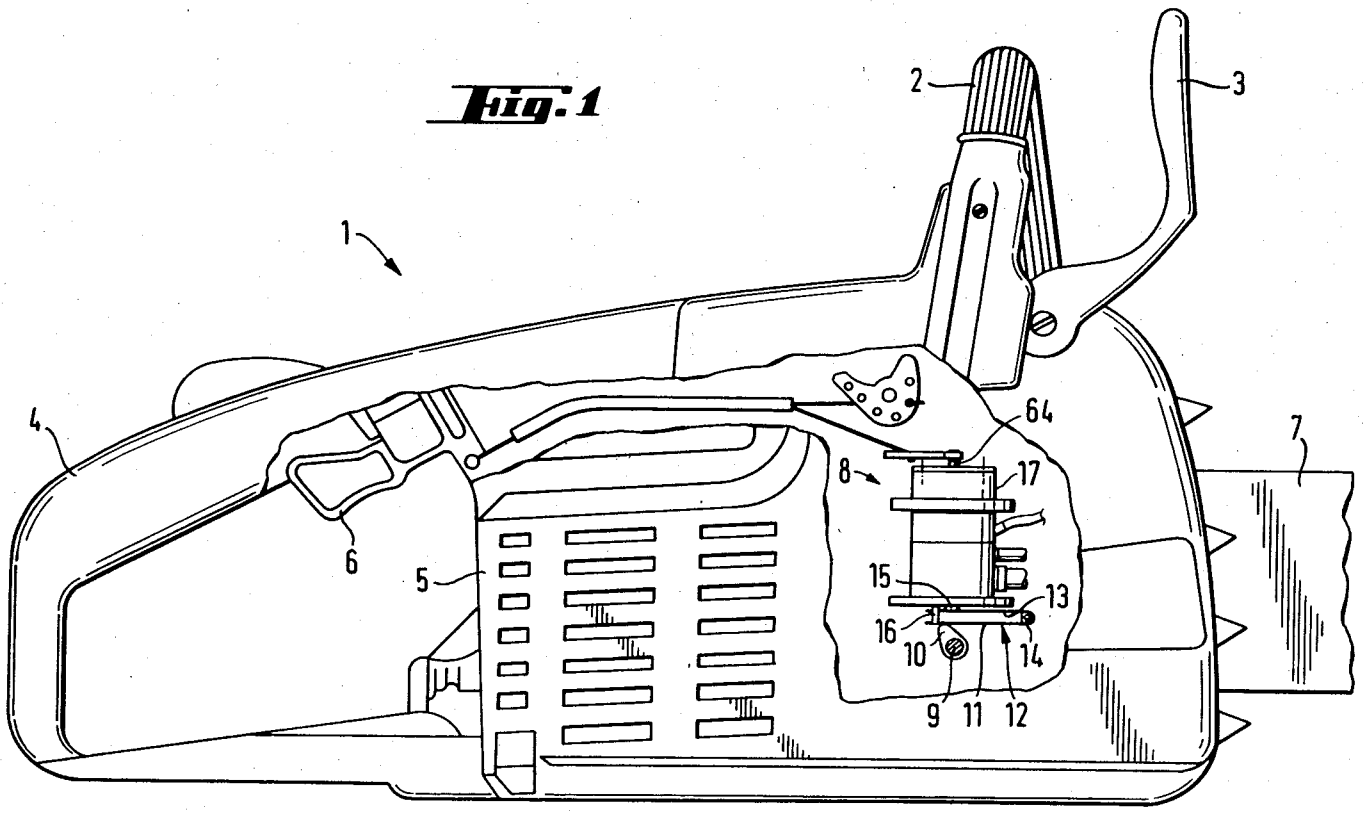
FIG. 1 is a side elevation view of a chain saw with a portion of the housing broken out to show the fuel injection apparatus of the invention; and, FIG. 2 is an enlarged section view of the fuel injection apparatus of FIG. 1.

The motor-driven chain saw 1 illustrated in the drawing includes a forward bail handle 2, a guard 3 mounted ahead of the handle 2 and a handle 4 extending rearwardly of the engine housing 5. The handle 4 includes a gas lever 6 for the high-speed two-stroke engine (not shown) mounted in housing 5. The two-stroke engine is provided for driving a saw chain (not shown) around a guide bar indicated by reference numeral 7.

For a precise control of speed and output, the small high-speed two-stroke engine is equipped with the fuel injection apparatus 8 of the invention. The fuel injection apparatus is coupled to gas lever 6 and is driven directly by the crankshaft 9 of the two-stroke engine. For this purpose, crankshaft 9 has a cam 10 which bears on the lower free leg 11 of a transmission member 12 configured as a U-shaped spring. In the curved or bight portion connecting lower leg 11 to upper leg 13, transmission member 12 is pivotally mounted about an axis 14 and functions as a pressure-control spring.

The upper leg 13 transmits the stroke movements introduced by cam 10 to the fuel injection apparatus 8 via a bearing 15. The forward free ends of legs 11 and 13 are held together by a retaining clamp 16 such that they can be compressed toward each other during an overstroke, but cannot be spread apart beyond the confines of the retaining clamp 16. The individual parts carried in housing 17 of fuel injection apparatus 8 of the invention are illustrated in a substantially enlarged scale in FIG. 2 and will be described in the following.

Housing 17 of fuel injection apparatus 8 includes a stacked arrangement of parts including a base plate 18, a lower housing part 19, a center housing part 20 and an upper housing part 21. A diaphragm 23 of a supply pump 22 is clamped between base plate 18 and lower housing part 19; whereas, a sealing diaphragm 24 is clamped between lower housing part 19 and center housing part 20. A sealing plate 25 is arranged between center part 20 and upper part 21. Upper part 21 is closed by a cover plate 26. A suction line 28 is connected to lower part 19 with a sealing ring 27 sandwiched therebetween. The suction line 28 accommodates a feed valve 29 through which the fuel drawn into the suction line is fed into pump chamber 30 and which also prevents backflow of the fuel coming from the tank.

A tappet 32 is displaceably journalled for movement in the axial direction in a bore 31 of lower housing part 19 in the region of the longitudinal center axis of housing 17. A bearing 15 of transmission member 12 rests against a lower flat 33 of the tappet 32. Tappet 32 is fixedly attached to diaphragm 23 of fuel supply pump 22 by means of two washers 34 between which diaphragm 23 is clamped. Tappet 32 is provided with a helical spring 35 which is received in an annular chamber 36 of lower housing part 19. The annular chamber 36 communicates with pump chamber 30 and the spring 35 bears against upper washer 34 thereby resiliently pressing diaphragm 23 and tappet 32 in a direction downwardly toward cam 10.

A connecting channel 37 accommodating a check valve 38 extends from annular chamber 36 to a scavenge chamber 39 which is provided in lower housing part 19. The scavenge chamber 39 is disposed in a plane above annular chamber 36 and extends transversely to axial bore 31, that is, essentially parallel to sealing diaphragm 24. At the top of lower housing part 19 and at the bottom of center housing part 20, scavenge chamber 39 has transverse recesses which, by means of sealing diaphragm 24 in the area of the transverse recesses, serve as pressure accumulators 40 for the fuel in scavenge chamber 39. In addition, scavenge chamber 39 has a control valve 42 on the side of lower housing part 19 which is connected to the latter with a sealing ring 41 disposed therebetween. The valve 42 permits excess fuel to return from scavenge chamber 39 to the tank.

In extending towards the top of lower housing part 19, bore 31 widens to form a valve chamber 43. Its diameter is about twice the diameter of bore 31. Valve chamber 43 accommodates a free-flying sealing body 44 configured as a ball. The length of valve chamber 43 is approximately twice its diameter. The diameter of ball-shaped sealing body 44 corresponds approximately to the diameter of valve chamber 43 which communicates with scavenge chamber 39.

Valve chamber 43 extends into center housing part 20 where it forms a stepped bore 45. The lower part of stepped bore 45 has the same diameter as valve chamber 43; whereas, its upper part has a smaller diameter. The length of the valve chamber 43 is determined by the diameter of the ball plus the magnitude of the cam lift. The transition region between the lower and upper parts of stepped bore 45 is defined by a tapered portion 46 which forms one of the boundaries of a pressure chamber 47. Stepped bore 45 of housing 17 accommodates an axially reciprocating pump piston 48 configured as a stepped piston. Piston 48 includes a head portion 49 and a guide portion 50 of reduced diameter. Head portion 49 is journalled in the larger-diameter region of stepped bore 45; whereas guide portion 50 is journalled in the reduced-diameter region of stepped bore 45. A valve seat 51 is formed at the lower end of head portion 49 and is provided for seating engagement with sealing body 44 in valve chamber 43.

On the center axis of head portion 49, there is a passageway 52 which is configured as a bore and extends from valve seat 51 in the direction of guide portion 50. The passageway 52 communicates with pressure chamber 47 via radially extending transverse bores 53. The transverse bores 53 of passageway 52 communicate with pressure chamber 47 in the region of a thrust face 54 of pump piston 48. The thrust face 54 forms one of the boundaries of pressure chamber 47 and is tapered in the transition region between head portion 49 and guide portion 50 of pump piston 48. Thrust face 54 is largely adapted to tapered portion 46 of stepped bore 45. An outlet channel 55 extends from tapered portion 46 of pressure chamber 47 to an outlet valve 56.

The pump piston 48 is sealed by two annular seals 57, 58 in the center part 20 of housing 17. While lower annular seal 57 is contiguous to sealing diaphragm 24 and seals the larger-diameter head portion 49 of pump piston 48, upper annular seal 58 is mounted next to sealing plate 25 and seals guide portion 50 of the pump piston 48. Thus, annular seals 57 and 58 are arranged at two axially opposite ends of pressure chamber 47. Annular seals 57, 58 are preferably made of an elastomer thereby providing a soft packing which affords a simple, low-cost and yet highly efficient sealing for pump piston 48 in housing 17.

Guide portion 50 of pump piston 48 extends through sealing plate 25 and projects with its end 59 into a chamber 60 of upper housing part 21. In chamber 60, a supporting collar 61 is secured to guide portion 50 and is adapted to rest against a return stroke stop 62 defined by sealing plate 25 of housing 17. A helical spring element 63 resiliently biases pump piston 48 downwardly in a direction toward sealing body 44 and is seated in chamber 60 between supporting collar 61 and cover plate 26. In addition, chamber 60 houses a pre-stroke stop 64 configured as a threaded screw. The pre-stroke stop 64 is arranged on the longitudinal center axis of chamber 60. The stop is threadably journalled in cover plate 26 and is continuously adjustable. Thus, the stroke of pump piston 48 is limited by the return stroke stop 62 and by the pre-stroke stop 64, with return stroke stop 62 being fixed while pre-stroke stop 64 is adjustable in accordance with requirements. Accordingly, for optimum fuel injection, stroke H of pump piston 48 can therefore be set so as to be larger or smaller.

Via transmission member 12, which is a U-shaped spring and yields only after a predetermined force is exceeded, cam 10 bears on tappet 32 loaded by return spring 35 in housing 17. The cam 10 is driven directly by the crankshaft 9 of the engine. The ball-shaped sealing body 44, which is free-floating in valve chamber 43, is disposed between the upper end of tappet 32 and valve seat 51 of pump piston 48. Sealing body 44 will seat fully onto valve seat 51 of pump piston 48 when tappet 32 urges sealing body 44 against valve seat 51. Pump piston 48 is of stepped configuration and is guided in stepped bore 45 of housing 17 and sealed relative thereto by the soft packings or annular seals 57, 58. This results in the formation of a pressure chamber 47 between the piston step and the bore step of housing 17 when sealing body 44 rests against valve seat 51. The pressure chamber 47 then is open only in the direction of outlet valve 56 and fuel is pumped from chamber 47 through this valve to injection line 65 when pump piston 48 goes through a positive upward stroke. The pump piston 48 is returned by the force of spring 63.

The maximum stroke of pump piston 48 is limited by pre-stroke stop 64 which is adjustable in dependence on the load condition of the engine. If end 59 of pump piston 48 abuts against pre-stroke stop 64, the entire assembly consisting of pump piston 48, sealing body 44 and tappet 32 is decelerated abruptly. Any further lift of the cam 10 is then absorbed as an idle stroke by over pressing transmission member 12.

Figure 2:
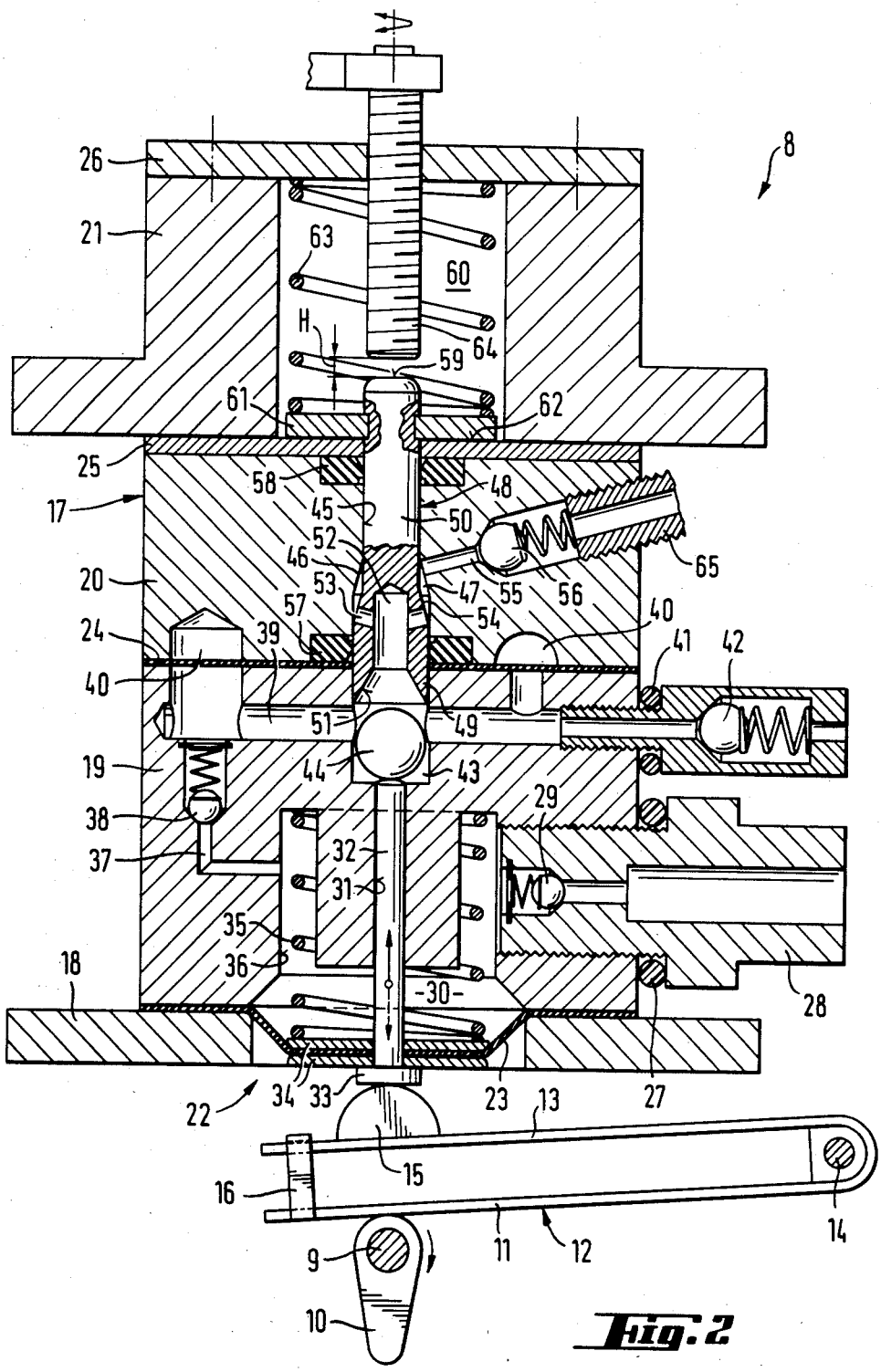

As cam 10 moves downwardly, transmission member 12 will first relax and hold the pump assembly against the forces of spring 35 and of spring 63 in abutment with the stop of tappet 32 until transmission member 12 comes to rest against its own stop formed by retaining clamp 16 and then follows the cam 10 together with the pump assembly like a rigid body with springs 35, 63 relaxing. With further downward movement, supporting collar 61 will first abut against return stroke stop 62 thereby stopping pump piston 48. By virtue of its inertia, sealing body 44 will then follow the movement of tappet 32 which continues to follow the movement of cam 10 assisted by the force of spring 35 thereby unseating itself from valve seat 51 of pump piston 48 (FIG. 2).

During the downward stroke of pump piston 48, valve seat 51 was closed by sealing body 44 and therefore an under-pressure was produced in pressure chamber 47 during the joint stroke of pump piston 48 and sealing body 44. Following the unseating of sealing body 44 from valve seat 51, this under-pressure causes fuel to be drawn by suction from scavenge chamber 39 through passageway 52 and transverse bores 53 in pump piston 48. Scavenge chamber 39 is at all times flushed with fuel, with control valve 42 operating as a controller for the supply pressure and returning excess scavenging fuel to the tank. Supply pump 22 includes: diaphragm 23, the pumping action of which is transmitted by tappet 32; pump chamber 30 with feed valve 29; and, an inlet check valve 38.

Alternatively, the pre-supply pump may also be a diaphragm pump operated by crankcase pressure as it is known from diaphragm carburetors. For the accumulation of pressure in scavenge chamber 39, pressure accumulator 40 formed by an arcuately-shaped bulge in sealing diaphragm 24 is provided. Its purpose is to prevent the pressure in the scavenge chamber from breaking down on the suction stroke of supply pump 22.

Sealing body 44 is configured as a free-floating ball and is self-centering on valve seat 51. Accordingly, there are no high requirements placed on its manufacture since the sealing body requires no special guidance and no centering problems occur. Also, the stepped pump piston 48 need not be lapped to fit into its mounting but is allowed to have some clearance. The housing 17 also need not meet high requirements because tolerances are taken up by the elastic annular seals 57, 58. Procuring high-precision ball-shaped sealing bodies 44 in large quantities presents no problem. Valve seat 51 may be slightly embossed and lapped. Preferably, the diameters of head portion 49 and of guide portion 50 of pump piston 48 are about 4 mm and 3.5 mm, respectively.

In an otherwise conventional pure piston control using adjusting or rotary pistons, there is always a dependency on the actual strokes and on the position of the housing relative to the cam or eccentric. The apparatus of the invention largely eliminates this dependent relationship. The apparatus of the invention can provide for an additional lift on cam 10 which is taken up by transmission member 12 thereby compensating for tolerances. Even in the event of thermal expansion of the crankshaft, a dependent relationship to the injection pump itself does not exist because the changes are readily taken up while maintaining proper functioning, even at a stroke of only about 0.1 mm to 0.2 mm.

The invention affords the advantage of permitting safe metering of minimal amounts of fuel for two-stroke engines at speeds of 10,000 rpm and more without the need to fulfill the usual precision requirements for injection systems, because the annular seals 57, 58 of the pump piston in the housing make it unnecessary to maintain fitting tolerances. Sealing is accomplished by these soft packings. The use of these soft packings or annular seals 57, 58 has only been made possible by the valve function of pump piston 48 (valve seat 51, sealing body 44) because, on the one hand, spring-loaded suction valves do not respond with sufficient speed for this application and because, on the other hand, piston rod controls including soft packings cannot be used, particularly since the seals are liable to damage.

The use of the over-pressure control spring or transmission member 12 simultaneously with pre-stroke stop 64 for the pump piston 48, makes the metering stroke independent of the wear of cam 10, tappet 32, transmission member 12, as well as of thermal expansions in this region because the stroke variations occurring as a result of wear or thermal expansion can be corrected by stroke reserves contained in transmission member 12. Thus, the injection apparatus 8 of the invention can be built to very small dimensions, simply and inexpensively.

It is understood that the foregoing description is that of the preferred embodiments of the invention and that various changes and modifications may be made thereto without departing from the spirit and scope of the invention as defined in the appended claims.

What is claimed is:

1. Fuel injection apparatus for a two-stroke engine such as small engines for fast running work tools, the engine having a fuel tank and a crankshaft, the apparatus comprising:

a housing;

pressure chamber means formed in said housing for receiving fuel to be injected into the engine;

valve means for controlling the admission of fuel into said chamber;

a pump piston mounted in said housing for reciprocatory movement therein along a predetermined axis;

channel means formed in said pump piston for conducting fuel into said pressure chamber means;

valve means for opening and closing said channel means in dependency upon said movement of said pump piston; and, actuating means for imparting said reciprocatory movement to said pump piston;

chamber means formed in said housing between said channel means and said actuating means;

said valve means including a valve seat formed on said piston at the inlet to said channel means; and, a free-flying sealing body disposed in said chamber means for movement into and out of contact engagement with said valve seat;

fuel supply means for supplying fuel to said channel means via said chamber means and said valve means; and, said actuating means including cam means driven by the crankshaft of the engine and, cam follower means for transmitting the movement of said cam means to said sealing body for moving the latter into contact engagement with said valve seat.

2. The fuel injection apparatus of claim 1, comprising:

annular sealing means disposed in surrounding relationship to said pump piston for sealing the same with respect to said housing.

3. The fuel injection apparatus of claim 2, said pump piston having a guide portion extending through said pressure chamber means, said sealing means including two annular seals for sealing said piston with respect to said housing at opposite ends of said chamber means.

4. The fuel injection apparatus of claim 3, said pump piston being an elongated member having said guide portion and a head portion extending from said guide portion along said axis, said valve seat being formed on said head portion; and, one of said annular seals being disposed in surrounding relationship to said guide portion and the other one of said annular seals being disposed in surrounding relationship to said head portion.

5. Fuel injection apparatus for a two-stroke engine such as small engines for fast running work tools, the apparatus comprising:

a housing;

pressure chamber means formed in said housing for receiving fuel to be injected into the engine;

valve means for controlling the admission of fuel into said chamber;

a pump piston mounted in said housing for reciprocatory movement therein along a predetermined axis;

channel means formed in said pump piston for conducting fuel into said pressure chamber means;

fuel supply means for supplying fuel to said channel means;

valve means for opening and closing said channel means in dependency upon said movement of said pump piston;

actuating means for imparting said reciprocatory movement to said pump piston; and, annular sealing means disposed in surrounding relationship to said pump piston for sealing the same with respect to said housing; and, said valve means including a valve seat formed on said piston at the inlet to said channel means; and, a free-flying sealing body disposed between said valve seat and said actuating means;

said pump piston having a guide portion extending through said pressure chamber means, said sealing means including two annular seals for sealing said piston with respect to said housing at opposite ends of said chamber means;

said pump piston being an elongated member having said guide portion and a head portion extending from said guide portion along said axis, said valve seat being formed on said head portion; and, one of said annular seals being disposed in surrounding relationship to said guide portion and the other one of said annular seals being disposed in surrounding relationship to said head portion;

said guide portion and said head portion conjointly defining a stepped piston, the diameter of said head portion being greater than the diameter of said guide portion, said pressure chamber means being a pressure chamber conjointly defined by said housing and said piston.

6. The fuel injection apparatus of claim 5, said piston having an exterior pressure surface defining one wall of said pressure chamber and said housing having a recess defining the other wall of said pressure chamber; said other one of said annular seals being disposed between said valve seat and said pressure surface.

7. The fuel injection apparatus of claim 6, said channel means including a central bore extending from said valve seat and along said axis; and, transverse bore means likewise formed in said pump piston for interconnecting said chamber and said central bore.

8. The fuel injection apparatus of claim 7, said pressure surface being conically tapered in the direction from said head portion to said guide portion, said recess having a wall surface which together with said pressure surface define the confines of said pressure chamber, said wall surface having a tapered portion corresponding to the tapered portion of said pressure surface.

9. The fuel injection apparatus of claim 2, said chamber means including scavenge chamber means formed in said housing and communicating with said valve seat, and said apparatus further comprising accumulator pressure means likewise formed in said housing next to said scavenge chamber means; and, a sealing membrane separating said scavenge chamber means from said accumulator pressure means.

10. The fuel injection apparatus of claim 9, said free-flying sealing body being configured as a valve sphere, said valve means further comprising a valve cavity formed in said housing and facing toward said valve seat along said axis, said valve cavity being dimensioned to accommodate said valve sphere and having a length measured along said axis, said length being greater than the sum of the stroke of said pump piston and the diameter of said valve sphere.

11. Fuel injection apparatus for a two-stroke engine such as small engines for fast running work tools, the apparatus comprising:

a housing;

pressure chamber means formed in said housing for receiving fuel to be injected into the engine;

valve means for controlling the admission of fuel into said chamber;

a pump piston mounted in said housing for reciprocatory movement therein along a predetermined axis;

channel means formed in said pump piston for conducting fuel into said pressure chamber means;

fuel supply means for supplying fuel to said channel means;

valve means for opening and closing said channel means in dependency upon said movement of said pump piston;

actuating means for imparting said reciprocatory movement to said pump piston; and, annular sealing means disposed in surrounding relationship to said pump piston for sealing the same with respect to said housing; and, said valve means including a valve seat formed on said piston at the inlet to said channel means; and, a free-flying sealing body disposed between said valve seat and said actuating means;

scavenge chamber means formed in said housing and communicating with said valve seat, said scavenge chamber means including a scavenge chamber formed in said housing; accumulator pressure means likewise formed in said housing next to said scavenge chamber means; and, a sealing membrane separating said scavenge chamber from said accumulator pressure means;

said free-flying sealing body being configured as a valve sphere, said valve means further comprising a valve cavity formed in said housing and facing toward said valve seat along said axis, said valve cavity being dimensioned to accommodate said valve sphere and having a length measured along said axis, said length being greater than the sum of the stroke of said pump piston and the diameter of said valve sphere;

said actuating means including a tappet bore formed in said housing beneath said valve cavity; a tappet movably mounted in said tappet bore so as to penetrate said valve cavity during the movement thereof for coming into contact engagement with said valve body for moving the latter; and, cam means for actuating said tappet for reciprocatory movement along said axis.

12. The fuel injection apparatus of claim 11, wherein the engine has a crankshaft, said cam means comprising a cam for imparting movement to said tappet, said cam being driven directly by the crankshaft of the engine.

13. The fuel injection apparatus of claim 12, said actuating means further comprising spring means for resiliently biasing said tappet in the direction of said cam; and, resilient transmitting means for transmitting the movement of said cam to said tappet.

14. The fuel injection apparatus of claim 13, said resilient transmitting means comprising a resilient U-shaped member and pivot means for pivotally mounting said U-shaped member at the bight portion thereof, said U-shaped member being disposed between said cam and said tappet so as to cause one of the legs of said U-shaped member to be in contact engagement with said cam and the other of the legs to be in contact engagement with said tappet.

15. The fuel injection apparatus of claim 14, said resilient transmitting means including restraint means for holding the legs of said U-shaped member from spreading apart beyond a predetermined limit.

16. The fuel injection apparatus of claim 9, comprising: fuel pump means for pumping fuel from the tank of the engine to said scavenge chamber means, said fuel pump means including a membrane attached to said tappet.

17. The fuel injection apparatus of claim 16, said fuel pump means including a pump chamber formed in said housing and said apparatus further comprising: a passage connecting said scavenge chamber means to said pump chamber; and, check valve means disposed in said passage.

18. The fuel injection apparatus of claim 3, comprising resilient means for resiliently biasing said pump piston in a direction toward said free-flying sealing body.

19. Fuel injection apparatus for a two-stroke engine such as small engines for fast running work tools, the apparatus comprising:

a housing;

pressure chamber means formed in said housing for receiving fuel to be injected into the engine;

valve means for controlling the admission of fuel into said chamber;

a pump piston mounted in said housing for reciprocatory movement therein along a predetermined axis;

channel means formed in said pump piston for conducting fuel into said pressure chamber means;

fuel supply means for supplying fuel to said channel means;

valve means for opening and closing said channel means in dependency upon said movement of said pump piston;

actuating means for imparting said reciprocatory movement to said pump piston; and, annular sealing means disposed in surrounding relationship to said pump piston for sealing the same with respect to said housing; and, said valve means including a valve seat formed on said piston at the inlet to said channel means; and, a free-flying sealing body disposed between said valve seat and said actuating means;

said pump piston having a guide portion extending through said pressure chamber means, said sealing means including two annular seals for sealing said piston with respect to said housing at opposite ends of said chamber means;

resilient means for resiliently biasing said pump piston in a direction toward said free-flying sealing body;

said resilient means including a supporting collar mounted on the end of said guide portion facing away from said valve seat; abutment means formed in said housing for receiving said collar thereagainst to arrest the movement of said pump piston thereby defining one end of the stroke of the latter; said resilient means further including a spring mounted in said housing so as to press against said supporting collar.

20. The fuel injection apparatus of claim 19, comprising continuously adjustable pre-stroke abutment means mounted in said housing for limiting the other end of said stroke when said pump piston moves in the pumping direction.

21. The fuel injection apparatus of claim 9, comprising valve control means arranged with respect to said scavenge chamber means for conducting surplus fuel to the tank of the engine.

22. Fuel injection apparatus for a two-stroke engine such as small engines for fast running work tools, the apparatus comprising:

a housing;

pressure chamber means formed in said housing for receiving fuel to be injected into the engine;

valve means for controlling the admission of fuel into said chamber;

a pump piston mounted in said housing for reciprocatory movement therein along a predetermined axis;

channel means formed in said pump piston for conducting fuel into said pressure chamber means;

fuel supply means for supplying fuel to said channel means;

valve means for opening and closing said channel means in dependency upon said movement of said pump piston;

actuating means for imparting said reciprocatory movement to said pump piston;

annular sealing means disposed in surrounding relationship to said pump piston for sealing the same with respect to said housing;

said valve means including: a valve seat formed on said piston at the inlet to said channel means; and, a free-flying sealing body disposed between said valve seat and said actuating means; and, said actuating means including: a tappet bore formed in said housing beneath said sealing body; a tappet movably mounted in said tappet bore so as to extend beyond the same during the movement thereof for coming into contact engagement with said sealing body for moving the latter; and, cam means for actuating said tappet for reciprocatory movement along said axis.

* * * * *